US008782822B1

(12) United States Patent
Vandenbergh

(10) Patent No.: US 8,782,822 B1
(45) Date of Patent: Jul. 22, 2014

(54) PLUNGER CUP WITH ELONGATED RIM

(76) Inventor: Dirk M. Vandenbergh, Ramona, CA (US)

( * ) Notice: Subject to any disclaimer, the term of this patent is extended or adjusted under 35 U.S.C. 154(b) by 1464 days.

(21) Appl. No.: 12/170,642

(22) Filed: Jul. 10, 2008

Related U.S. Application Data

(60) Provisional application No. 60/962,724, filed on Jul. 30, 2007.

(51) Int. Cl.
*E03D 9/00* (2006.01)

(52) U.S. Cl.
USPC ..... 4/255.01

(58) Field of Classification Search
CPC ..... E03D 9/00
USPC ..... 4/255.01, 255.05, 255.11, 255.08, 300
See application file for complete search history.

(56) References Cited

U.S. PATENT DOCUMENTS

| | | | | |
|---|---|---|---|---|
| 1,193,476 | A * | 8/1916 | Block | 4/255.11 |
| 1,508,265 | A * | 9/1924 | Bailey | 401/15 |
| 5,384,918 | A * | 1/1995 | Leighton et al. | 4/255.05 |
| 5,524,296 | A * | 6/1996 | Leighton | 4/255.05 |
| 7,120,943 | B2 * | 10/2006 | Allenbaugh et al. | 4/255.11 |
| 2008/0134421 | A1 * | 6/2008 | Sheffield et al. | 4/255.11 |

* cited by examiner

*Primary Examiner* — Lori Baker
(74) *Attorney, Agent, or Firm* — Edward W. Callan

(57) ABSTRACT

A plunger cup of a flexible material for sealing an opening of a drain has an elongated rim for sealing an opening of a drain. This plunger cup is particularly useful for releasing stoppages in a clogged drain having a noncircular opening.

1 Claim, 1 Drawing Sheet

PLUNGER CUP WITH ELONGATED RIM

CROSS-REFERENCE TO RELATED APPLICATION

This is a continuation of U.S. Provisional Patent Application No. 60/962,724 filed Jul. 30, 2007.

BACKGROUND OF THE INVENTION

The present invention generally pertains to plungers and is particularly directed to sealing a plunger cup about an opening of clogged plumbing. In the context of this application "about" is defined as "all around".

A plunger is an apparatus that is used for releasing stoppages in plumbing, such as a clogged drain from a toilet bowl or a sink. A plunger is sometimes referred to as a "plumber's helper". A plunger includes a cup of a flexible material, such as rubber, and a stick that is attached to the base of the cup for maneuvering the cup.

The cup of a sink plunger has a flat rim that is circular for sealing an opening of a drain from a sink. The opening of a clogged sink drain is sealed by maneuvering the stick of the plunger to push the cup down against the surface of the sink about the drain. When the cup is then pulled away from the clogged drain, a vacuum is created in the drain and the vacuum causes whatever is clogging the drain to loosen or break up, whereby the stoppage is usually released after one or more efforts with the plunger. A sink plunger is also used for releasing stoppages in a clogged drain from a toilet bowl, bathtub, shower, or the like in the same manner that it is used for releasing stoppages in a clogged drain from a sink.

The cup of a toilet bowl plunger includes a circular rim and a flange that extends from the rim and is configured to fit within an opening of a drain from a toilet bowl for sealing the opening. The opening of a clogged toilet bowl drain is sealed by maneuvering the stick of the toilet bowl plunger to push the flange of the cup down against the surface of the opening of the drain. When the cup is then pulled away from the clogged drain, a vacuum is created in the drain and the vacuum causes whatever is clogging the drain to loosen or break up, whereby the stoppage is usually released after one or more efforts with the plunger. A toilet bowl plunger is also used for releasing stoppages in a clogged drain from a sink, bathtub, shower, or the like (fixture) by flipping up the flange to be above the rim so that the opening of the clogged drain can be sealed by maneuvering the stick of the plunger to push the cup down against the surface of the fixture about the drain.

The above-described plunger cups are not always useful for releasing stoppages in a clogged drain having a noncircular opening.

SUMMARY OF THE INVENTION

The present invention provides a plunger cup, comprising: a cup of a flexible material for sealing an opening of a drain, wherein the cup has an elongated rim for sealing an opening of a drain, and wherein the rim has a flat surface for sealing an opening of a drain. This plunger cup is more effective than the above described prior art plunger cups for releasing stoppages in a clogged drain having a noncircular opening.

Additional features of the present invention are described with reference to the detailed description.

DETAILED DESCRIPTION

Figure 1:
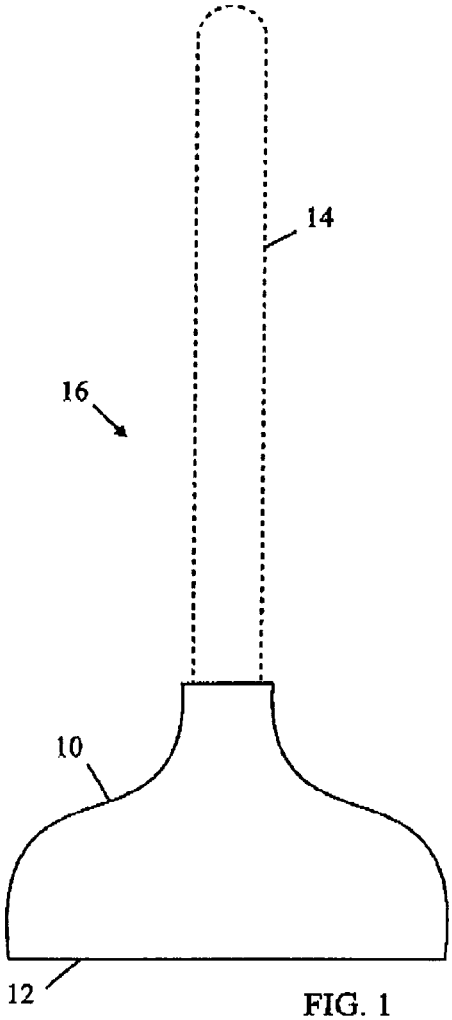
FIG. 1 is a front view of one embodiment of a plunger cup according to the present invention, with the cup being attached to a plunger stick shown in dashed lines.
Figure 2:
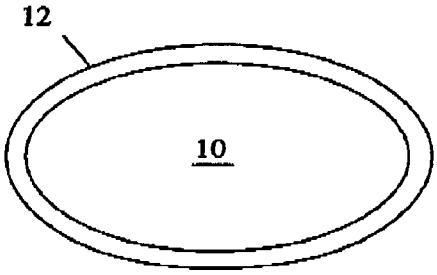
FIG. 2 is a bottom view of the plunger cup shown in FIG. 1.

Referring to FIGS. 1 and 2, one embodiment of a plunger cup 10 according to the present invention is made of a flexible material and has an elongated rim 12 for sealing a noncircular opening of a drain. The rim 12 is flat. In a preferred embodiment, the rim 12 has a somewhat oval shape, as shown in FIG. 2. In alternative embodiments, the rim has some other elongated shape. The base of the cup 10 is attached to a stick 14 to constitute a plunger 16.

The opening of a clogged sink drain is sealed by maneuvering the stick 14 of the plunger 16 to push the cup 10 down against the surface of the sink about the drain. When the cup 10 is then pulled away from the clogged drain, a vacuum is created in the drain and the vacuum causes whatever is clogging the drain to loosen or break up, whereby the stoppage is usually released after one or more efforts with the plunger 16. This embodiment of a plunger cup is also used for releasing stoppages in a clogged drain from a toilet bowl, bathtub, shower, or the like in the same manner that it is used for releasing stoppages in a clogged drain from a sink.

Figure 3:
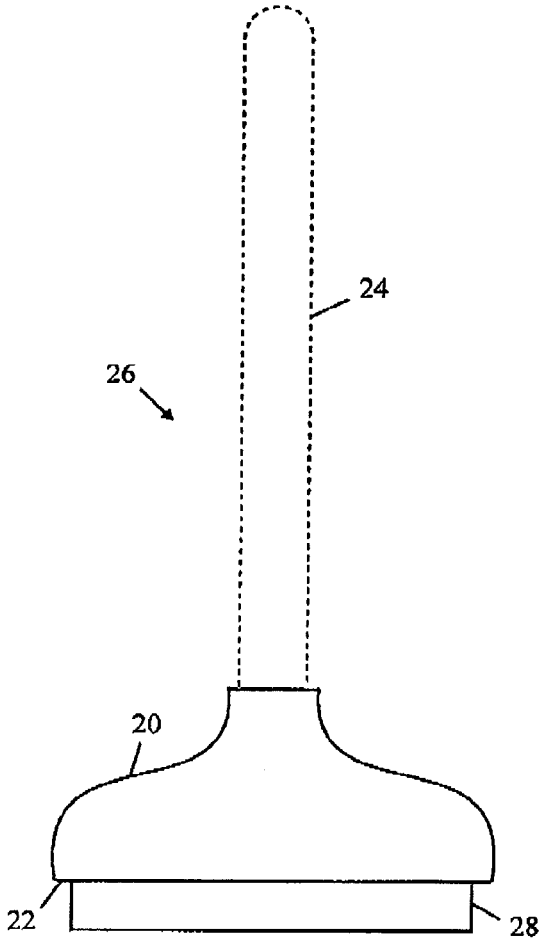
FIG. 3 is a front view of another embodiment of a plunger cup according to the present invention, with the cup being attached to a plunger stick shown in dashed lines.
Figure 4:
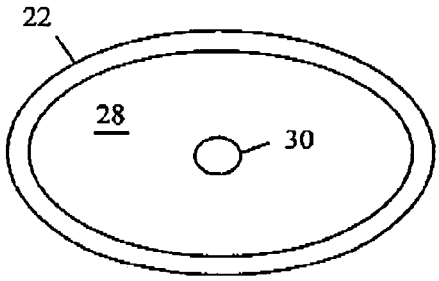
FIG. 4 is a bottom view of the plunger cup shown in FIG. 3.

Referring to FIGS. 3 and 4, another embodiment of a plunger cup 20 according to the present invention is made of a flexible material and has an elongated rim 22 for sealing a noncircular opening of a drain, such as an elongated drain from a toilet bowl. In a preferred embodiment, the rim 22 has a somewhat oval shape, as shown in FIG. 4. In alternative embodiments, the rim has some other elongated shape.

The base of the cup 20 is attached to a stick 24 to constitute a plunger 26. The cup 20 further includes a flange 28 that extends from the rim and is configured to fit within an opening of a drain from a toilet bowl for sealing the opening. There is a hole 30 in the center of the flange 28.

The opening of a clogged toilet bowl drain is sealed by maneuvering the stick 24 of the plunger 26 to push the flange 28 of the cup 20 down against the surface of the opening of the drain. When the cup 20 is then pulled away from the clogged drain, a vacuum is created in the drain and the vacuum causes whatever is clogging the drain to loosen or break up, whereby the stoppage is usually released after one or more efforts with the plunger 26. This embodiment of a plunger cup 20 is also used for releasing stoppages in a clogged drain from a sink, bathtub, shower, or the like (fixture) by flipping up the flange 28 to be above the rim 22 so that the opening of the clogged drain can be sealed by maneuvering the stick 24 of the plunger 26 to push the cup 20 down against the surface of the fixture about the drain.

In alternative embodiments (not shown) a plunger cup having an elongated rim in accordance with the present invention may be configured other than as shown herein and described with reference to the drawing, and may include additional features not disclosed herein.

The benefits specifically stated herein do not necessarily apply to every conceivable embodiment of the present invention. Further, such stated benefits of the present invention are only examples and should not be construed as the only benefits of the present invention.

While the above description contains many specificities, these specificities are not to be construed as limitations on the scope of the present invention, but rather as examples of the preferred embodiments described herein. Other variations are possible and the scope of the present invention should be determined not by the embodiments described herein but rather by the claims and their legal equivalents. The claims require no implicit limitations. Each claim is to be construed explicitly as stated, or by its legal equivalent.

The invention claimed is:

1. A plunger cup, comprising:

a cup of a flexible material for sealing an opening of a drain;

wherein the cup has an elongated rim for sealing an opening of a drain; and wherein the rim has a flat surface for sealing an opening of a drain.

* * * * *